United States Patent [19]

Miehlich

[11] Patent Number: 4,563,999

[45] Date of Patent: Jan. 14, 1986

[54] BALL SEPARATING DEVICE FOR BALL THROWING MACHINES, ESPECIALLY FOR SQUASH BALLS OR TENNIS BALLS

[76] Inventor: Dieter Miehlich, Holzweg 59, D-8900 Augsburg, Fed. Rep. of Germany

[21] Appl. No.: 469,923

[22] Filed: Feb. 25, 1983

[30] Foreign Application Priority Data

Mar. 24, 1982 [DE] Fed. Rep. of Germany ..... 32010828
Apr. 22, 1982 [DE] Fed. Rep. of Germany ... 8211663[U]
Aug. 12, 1982 [DE] Fed. Rep. of Germany ..... 3230052

[51] Int. Cl.[4] ..... F41B 15/00
[52] U.S. Cl. ..... 124/50; 124/78
[58] Field of Search ..... 124/78, 50, 49, 48, 124/41 R, 45; 273/26 D

[56] References Cited

U.S. PATENT DOCUMENTS

| | | | |
|---|---|---|---|
| 3,785,358 | 1/1974 | D'Angelo et al. | 124/78 |
| 3,844,267 | 10/1974 | Mohr | 124/49 X |
| 3,978,841 | 9/1976 | Yarur et al. | 124/50 |
| 4,122,822 | 10/1978 | Scheiwiller | 124/50 X |
| 4,207,857 | 6/1980 | Balka | 124/50 X |
| 4,270,511 | 6/1981 | Ehama | 124/50 X |

FOREIGN PATENT DOCUMENTS 2828188 11/1979 Fed. Rep. of Germany ..... 124/50

*Primary Examiner*—Richard J. Apley
*Assistant Examiner*—William R. Browne
*Attorney, Agent, or Firm*—Peter K. Kontler

[57] ABSTRACT

In a ball throwing machine, especially for squash balls or tennis balls, there is located on the base of a ball storage container a ball separating device in the form of a driven turntable which is arranged so as to be rotatable in a substantially horizontal plane and has on a circumferential circle substantially vertical passages of a width somewhat greater than the diameter of the balls to be separated. The turntable has a thickness corresponding to a multiple of a ball diameter and at the ball delivery point it has a ball stop which is located at a distance equivalent to approximately one ball diameter above the base member and there at least partially blocks the passages and for that purpose extends into a peripheral groove of the turntable. Each passage is located above a discrete base member which is connected to the turntable and rotates together with the turntable and gives way selectively below each passage in the peripheral sector of the ball discharge opening.

15 Claims, 10 Drawing Figures

BALL SEPARATING DEVICE FOR BALL THROWING MACHINES, ESPECIALLY FOR SQUASH BALLS OR TENNIS BALLS

BACKGROUND OF THE INVENTION

The invention relates to a ball separating device for ball throwing machines, especially squash balls or tennis balls, which is arranged in the form of a driven turntable so as to be rotatable substantially horizontally on the base of a ball storage container and has on a circumferential circle substantially vertical passages of a width somewhat greater than the diameter of the balls to be separated, these passages being kept closed at their lower ends over the extent of their circumferential path by a base surface and only opened in the region of a ball delivery point, whilst in the peripheral region of the ball delivery point at a distance equivalent to approximately one ball diameter above the base surface the passages are covered at least partially by a ball stop.

Thus the invention relates to ball throwing machines such as are commonly used in tennis training and from which balls which are held in a ball storage container are thrown out individually at intervals.

Such ball separating devices are equipped as perforated discs or star wheels with four or more passages distributed over the periphery and are set in slow rotation by a geared motor. For the separation of the balls it is necessary that during the stage in the rotation through which each passage passes between the moment of release of the ball stop after passing over the discharge opening and reaching the next ball stop a ball from the ball store enters the passage and comes to rest on the base surface. With a rapid succession of balls it can happen that as a result of bridge formation by balls accumulated in the ball storage container above the turntable a ball does not regularly enter the passage so that the ball throwing machine then has so-called misfires. This occurs particularly when the surfaces of the balls adhere strongly to one another, that is to say with roughened tennis balls or particularly with squash balls the surface of which has a high coefficient of friction. The ball throwing rhythm, which is actually determined by the rate of rotation of the turntable, is then disrupted.

When this separation principle is applied to balls with very high coefficients of friction of their surfaces, such as for example squash balls, the diffuculty also arises that a ball which is lying in a passage in the turntable and must roll down onto the base surface located below it during rotation on the turntable and must therefore slide over the walls surrounding the passage is prevented from rolling down satisfactorily by the high surface friction and is drawn into any small gap between the turntable and the base surface or in the case of an open spider even the wall surfaces and is destroyed, which leads to momentary blocking of the separating device. Therefore it is not possible for a known separating device for tennis ball throwing machines to be used for squash balls simply by adapting the dimensions.

It was also shown that in certain cases of particularly strongly adhering ball surfaces the previously known construction of the ball stop in the form of a stretched thread which crosses the passage in the peripheral region of the ball delivery point at a distance of approximately one ball diameter above the base surface can result in disruption of the ball separation. The cause of this can be the flexibility of the thread but can also be the relatively steep lead angle with which the thread enters the circumferential path of the balls located in the passages.

Reference is made to the published German patent application No. 22 62 880 to Dieter Miehlich and to the U.S. Pat. No. 4,086,903 to Jack C. Scott.

OBJECTS AND SUMMARY OF THE INVENTION

The object of the invention, therefore, is to construct a ball separating device of the type referred to in the introduction in such a way that the occurrence of misfires is practically eliminated and there is no danger that during separation balls with a high coefficient of friction are squashed by the turntable of the ball separating device which is rotating relative to the ball storage container and thus block the ball throwing machine.

In particular according to the invention it should be ensured that a ball stands ready in every passage which during rotation reaches the ball delivery point above the discharge opening.

According to the invention it should also be ensured that during rotation of the turntable the balls contained in their passages must not move relative to any wall or base surfaces so that there is no danger of them being drawn into gaps and squashed.

It is a further object of the invention that the balls do not undergo any significant relative movement, and thus restrictive friction, with respect to the ball stop by means of which all further balls with the exception of the lowest ball in the passage are to be blocked above the discharge opening to prevent the balls from falling through.

The principal object of the invention is achieved in such a way that the thickness of the turntable is a multiple of the diameter of a ball and that level with the ball stop the turntable has a peripheral groove which extends to approximately the radius of the centers of the passages and into which the ball stop extends.

This solution is based upon the idea that the time for accommodating a ball in each discharge opening is increased from barely one revolution to almost two revolutions when the thickness of the turntable amounts to only twice the diameter of a ball. Within this time practically all the bridges between balls are eliminated by the movements of the ball throwing machine itself, and experiments have shown that misfires are practically precluded.

In order for a ball located in the lowest position in a passage in the turntable to be prevented from moving relative to the walls surrounding it, it is further provided that the base surface below each passage rotates together with the turntable and is movable in such a way that it gives way selectively under each passage in the peripheral sector of the discharge opening. Therefore during the rotation of the turntable the ball rests quite still on the base surface which closes the bottom of the passage and is released through the discharge opening by selective yielding of the base surface so that the ball can be delivered to an associated ball accelerating mechanism and, as already mentioned above, the ball located above it in the passage is prevented from falling through by the ball stop. The base surfaces of the individual passages connected to the turntable can be of various constructions as will be explained at a later point.

Finally the movement of the ball stop relative to the balls which are located in the passages and are rotating with the turntable is reduced to a minimum by constructing the ball stop according to the invention as a ring which is mounted so as to be freely rotatable in the peripheral groove eccentrically to the turntable, the ring being radially supported against a housing wall of the storage container surrounding the turntable and constantly varying its position relative to the turntable by suitable arrangement of the supports in such a way that the passage in the turntable immediately above the discharge opening is always barred to balls coming from above.

To ensure that the base surface rotating with the turntable gives way in the peripheral sector of the ball discharge opening, numerous possible solutions are conceivable in principle, several of which are set out in the specific embodiments. As soon as the ball has passed through an opening in the turntable and is above the discharge opening, the base surface must again close the lower side of the passage in the further course of rotation.

A particularly simple and convenient solution using this principle according to the invention is achieved with the aid of foil tabs which are mounted at the underside of the turntable in front of each passage in the direction of rotation and in each case extend essentially over the surface of the succeeding passage in the direction of rotation. Thus they are dragged by the turntable over the stationary base of the ball storage container, which is known in tennis ball throwing machines, below the turntable, they support the balls lying in the passages and are deflected downwards by the weight of the ball lying above at the moment in which they pass over the discharge opening in the base, so that a ball is then released into the ball accelerating mechanism.

However, it is also conceivable not to provide a stationary base below the turntable and to close the individual passages by drop shutters or the like which are deflected at the location of the discharge opening with the aid of control means such as ramps or the like and then put back after release of the ball. Such drop shutters or the like can be influenced in one direction of movement by a control device and in the other direction of movement can be loaded by pivot springs so that very rapid opening and closing movements can be achieved.

BRIEF DESCRIPTION OF THE DRAWINGS

Embodiments of the invention will now be described in greater detail in connection with the drawings, in which.

DESCRIPTION OF THE PREFERRED EMBODIMENTS

Figure 1:
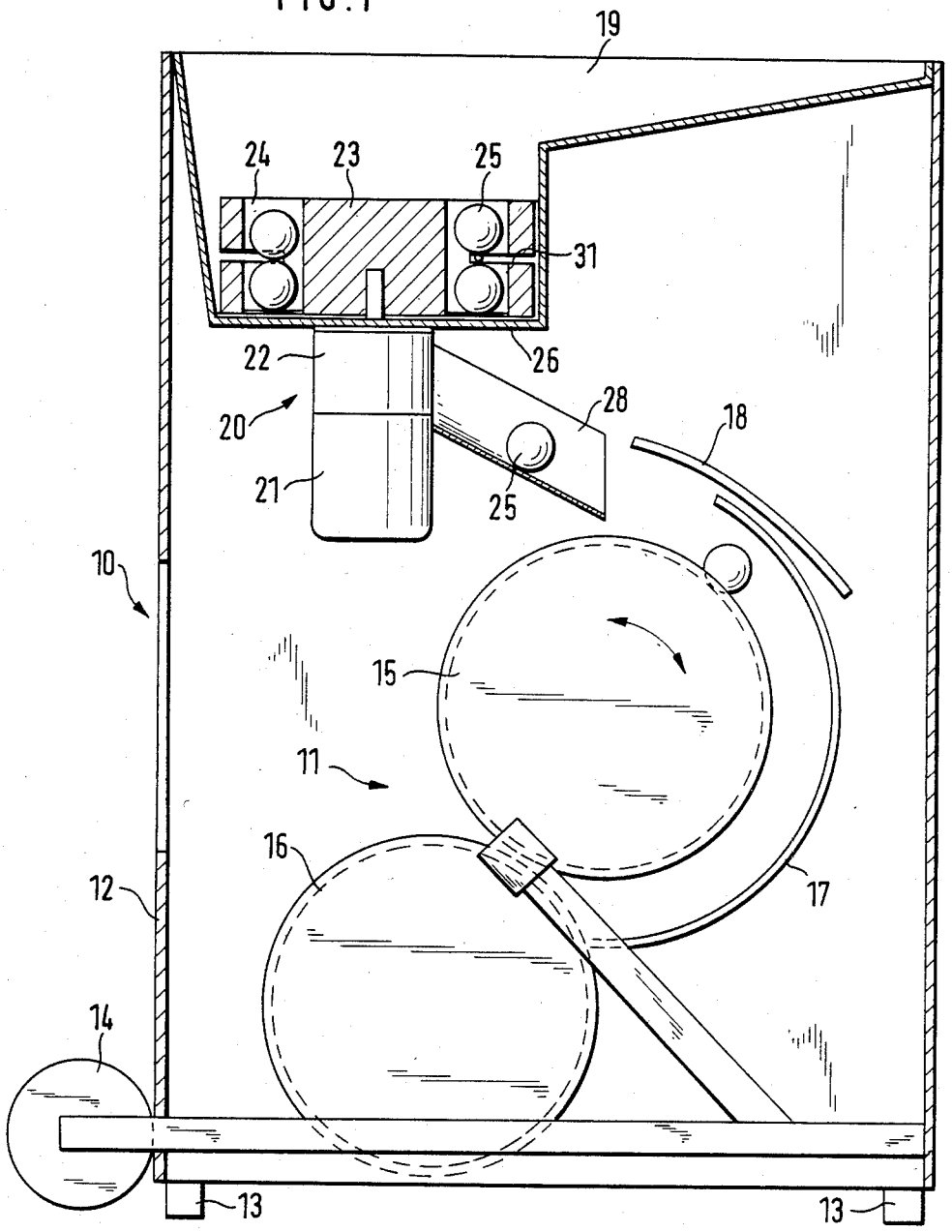
FIG. 1 is a vertical sectional view of a squash ball throwing machine in which the ball accelerating mechanism is only indicated schematically.

FIG. 1 shows a ball throwing machine 10 for squash balls in a vertical sectional view, in which the individual parts and in particular the ball accelerating mechanism 11 are simplified for the sake of clarity to prevent the description of the invention being unnecessarily complicated. The housing 12 of the machine rests on leg 13 and can be tilted so that it can be moved from one location to another on rollers 14. The ball accelerating mechanism 11 is mounted on the frame of the ball throwing machine 10 in the usual way so that it is pivotable in two dimensions and balls can be thrown out as required, and the ball accelerating discs 15,16 thereof can be controlled as regards rate of rotation and mutual spacing. The ball is guided around the upper accelerating disc 15 by a two-part intake ring of which the inner intake ring 17 which surrounds the upper ball accelerating disc 15 is fixed relative to the axle of this disc 15, whilst the outer intake ring 18 is fixed on the frame.

The machine 10 has a funnel-shaped ball storage container 19 on the base of which is located the ball singularizing or separating mechanism which is designated by the character 20. It has a turntable 23 which is driven by a motor 21 with a gear 22 and has vertical passages 24 for the balls 25 to be separated. Further balls in the storage container 19 are not shown. The gear 22 is flanged at the front end onto a base 26 below the turntable 23.

The passages 24 have a diameter which is somewhat greater than the ball diameter. In the base 26 at a point in the peripheral region of the passages a discharge opening 27 (see FIG. 3) is located below which a U-shaped chute 28 is arranged into which the balls 25 fall and as a result of the inclination of the chute 28 are passed to the gap between the upper accelerating disc 15 and the intake rings 17,18.

Figure 3:
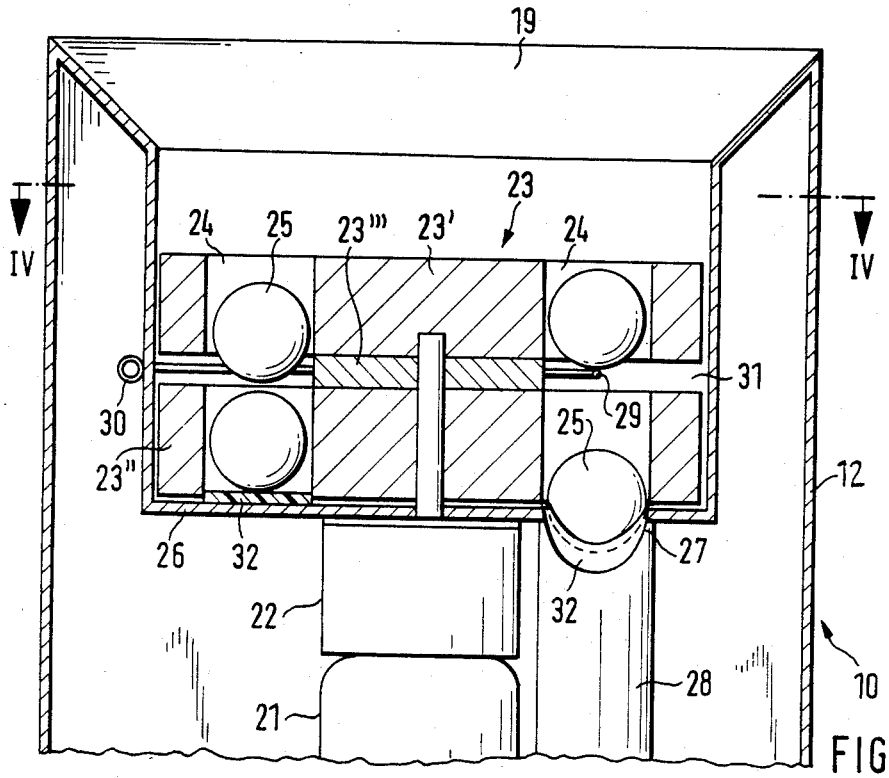
FIG. 3 is a vertical sectional view of the upper portion of a further embodiment of the ball separating device according to the invention in a plane rotated by 90° relative to FIG. 1.

In FIG. 3, which shows a section rotated about 90° through the upper part of the ball throwing machine along the vertical axis of the turntable 23, the turntable is shown in more detail. It has a thickness corresponding to approximately two ball diameters so that two balls can lie one above the other in the passages 24. However, in order for one single ball at the location of the discharge opening 27 to fall downwards, an annular groove 31 which is formed by stacking two discs 23',23'' one above the other with a spacer disc 23''', between them is provided in the peripheral surface of the turntable 23. A wire 29 is stretched like a chord in this annular groove 31 so that the upper ball lying in the passage is raised above the discharge opening 27 and the wire 29 prevents it from falling downwards onto the ball 25 located below it and lying on the base surface. This construction of the turntable 23 reduces the likelihood of a break in the throwing sequence.

FIGS. 2(A) to (D) show four different constructions of the base surfaces below the passages, and of course only one construction is used in each case on a turntable.

Figure 2A:
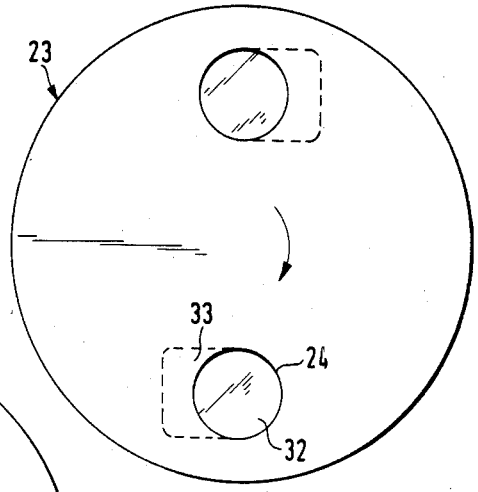
FIGS. 2(A) to (D) are plan views of the turntable of the machine according to FIG. 1 in which different variants of the closure of the lower end of the passages are indicated in each.
Figure 4:
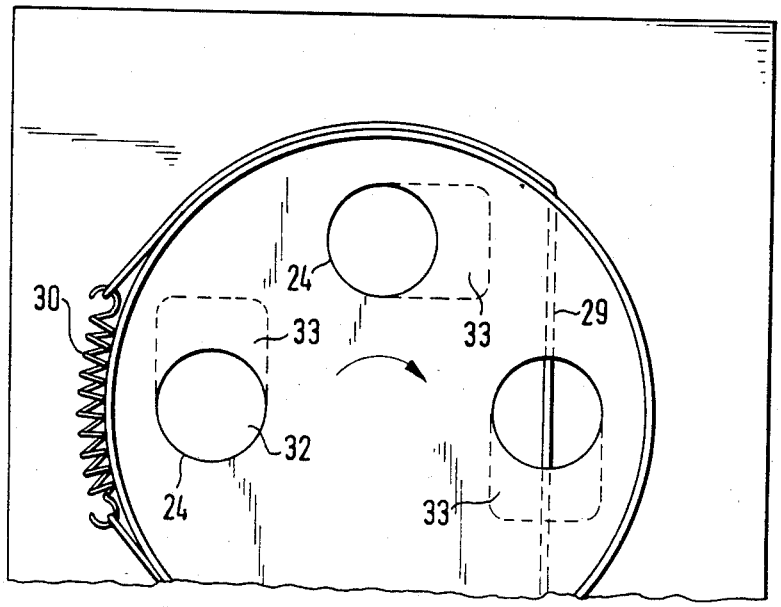
FIG. 4 is a plan view of the ball separating device in the plane IV—IV of FIG. 3.

A particularly simple and effective construction of the turntable is shown in FIG. 2(A), and this is the construction used in the ball throwing machine according to FIGS. 1, 3 and 4. Here the turntable rotates only a small distance above a stationary base 26 of the ball storage container 19 in which the ball discharge opening 27 is also located. The base surface below each passage 24 which rotates together with the turntable 23 is formed by a foil tab 32 which is fixed to the underside of the turntable 23 in front of each passage 24 and is drawn over the base 26, thus closing the lower end of the passage 24. Thus the ball 25 located in the passage rests on the foil tab 32 until the latter is pushed downwards at the location of the discharge opening 27 by the weight of the ball 25 and the ball can fall into the chute 28. When the turntable 23 rotates further in the direction indicated by the arrow in FIGS. 2 and 4 the foil tab 32 then again lies flat on the base surface below the passage 24.

In order to maintain the smallest possible distance between the turntable 23 and the base 26, areas 33 can be milled out of the underside of the turntable for the foil tabs 32, as is indicated in FIG. 2(A) and in FIG. 4 in front of the passages 24 in the direction of rotation.

Figure 2B:
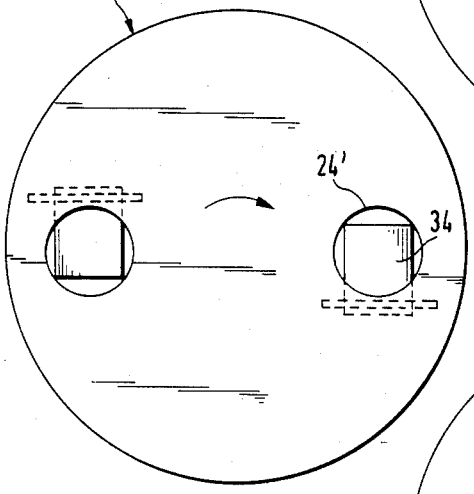
Figure 2C:
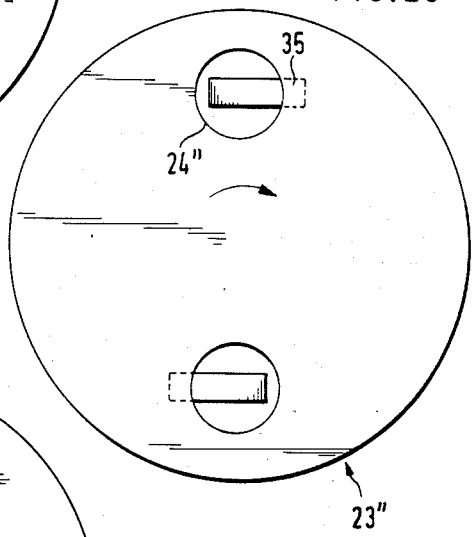

The FIGS. 2(B) and 2(C) show different constructions of the base surfaces rotating together with the turntables 23' and 23'', respectively. A drop shutter 34 or a drag bar 35 is articulately mounted at the underside of the turntable and can be swung down in the region of the discharge opening 27 and then raised again, for which purpose control devices in the form of ramp surfaces, for example also on the base 26, can be arranged—these are not shown specifically since it will be obvious to an expert in the art to use them in the case of need.

Figure 2D:
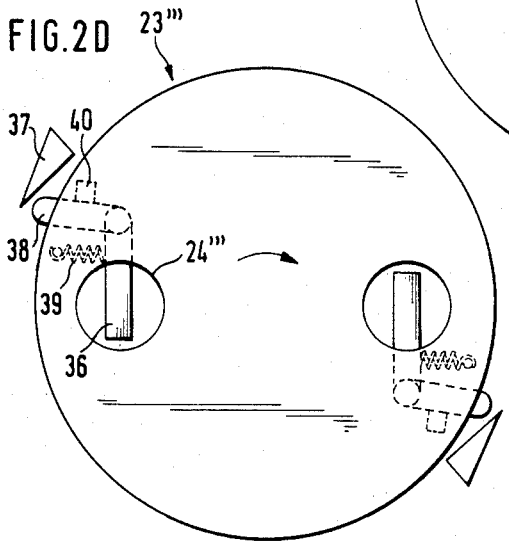

FIG. 2(D) shows yet another embodiment of the base surface closing the passage in the form of a swivel arm 36 which can pivot about an axis parallel to the axis of the turntable. For this purpose a deflecting cam 37 can be mounted stationarily at a suitable point and a control arm 38 firmly connected to the swivel arm 36 butts against it and deflects the swivel arm against the force of a return spring 39 until the control arm 38 slides off the cam 37 and the swivel arm is drawn by the spring 39 against a stop 40, so that the rest position of the swivel arm 36 is determined below the passage 24'''.

Although the turntables 23 to 23''' of FIGS. 2(A) to (D) have been shown as equipped with two passages 24 to 24''', respectively, needless to say that a different number of passages including one can be used.

In connecction with FIG. 4 it should be remarked that the chord 29 which serves as a ball stop is kept stretched by a spring 30.

It goes without saying that in the rigid base surfaces according to the embodiments of FIGS. 2(B) to (D) no stationary base is needed below the turntable as is required for the construction with the foil tabs 32 according to FIG. 2(A).

Figure 5:
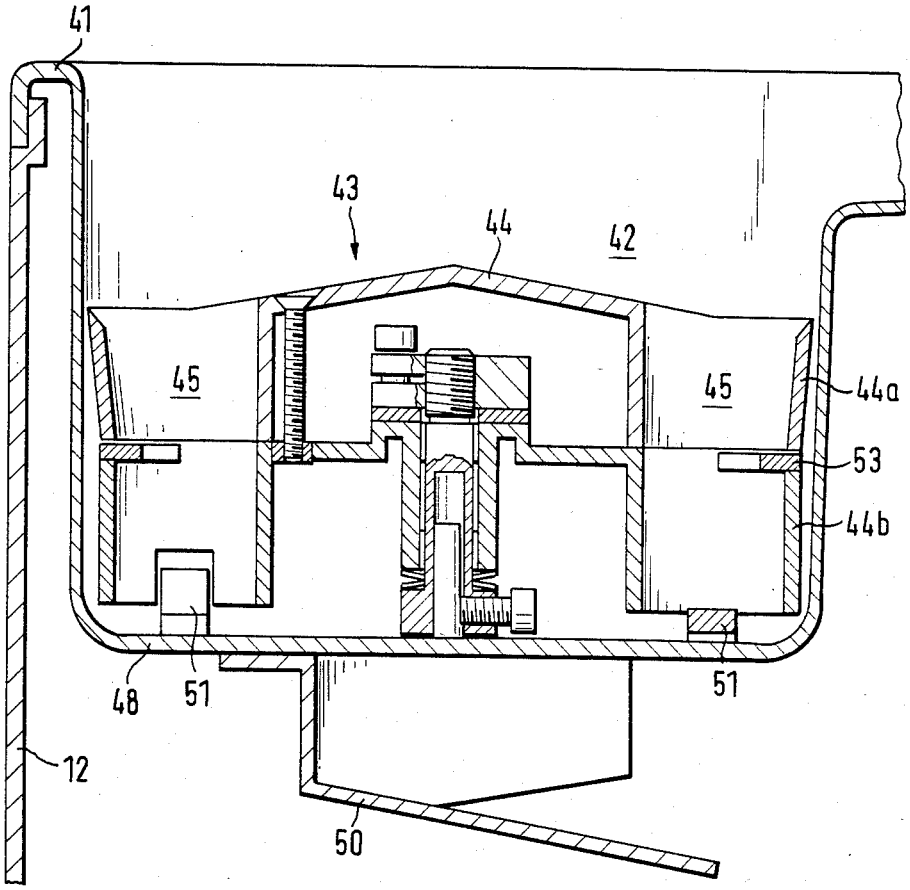
FIG. 5 is a vertical sectional view of a further embodiment of the ball separating device according to the sectional plane V—V in FIG. 6.
Figure 6:
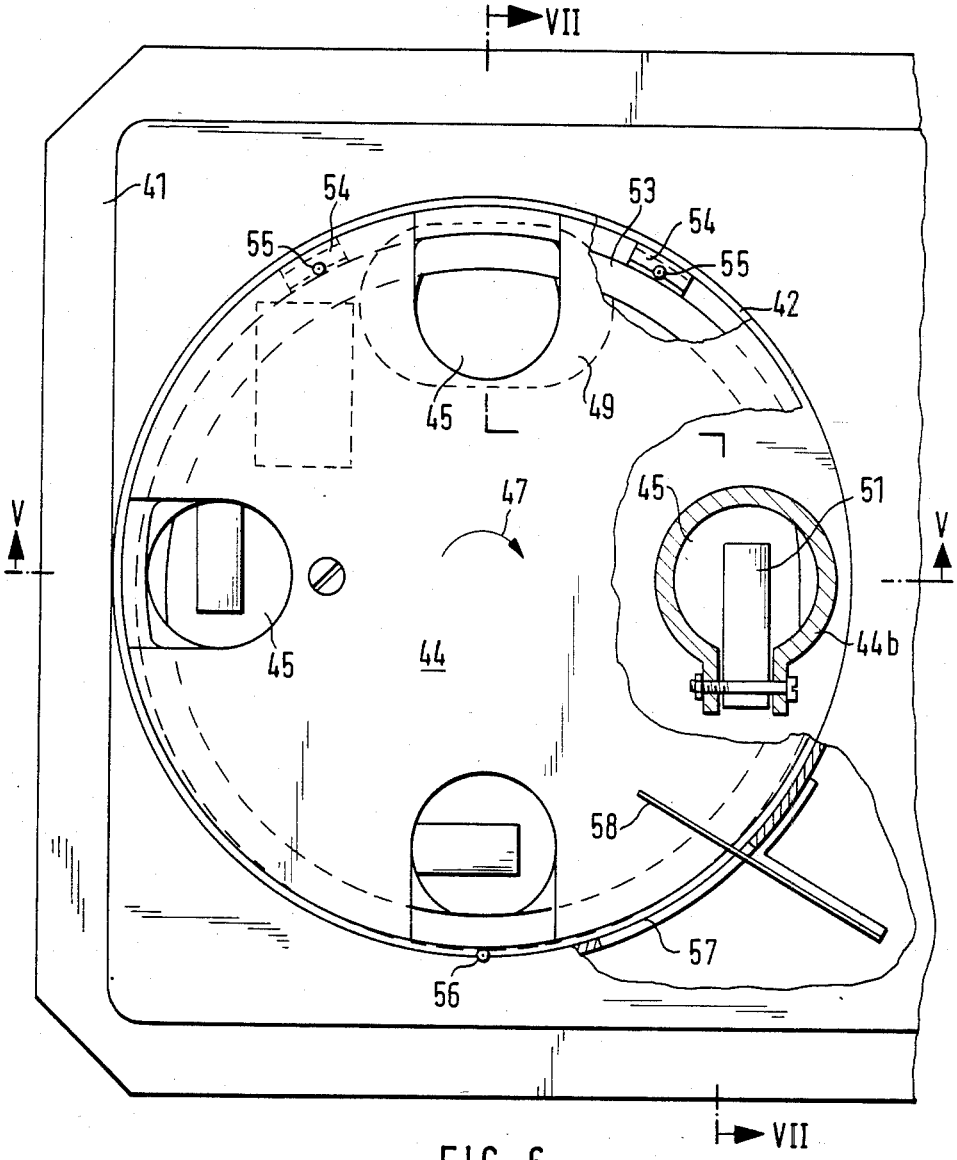
FIG. 6 is a fragmentary plan view of the ball separating device according to FIG. 5 in the ball storage container of the ball throwing machine.
Figure 7:
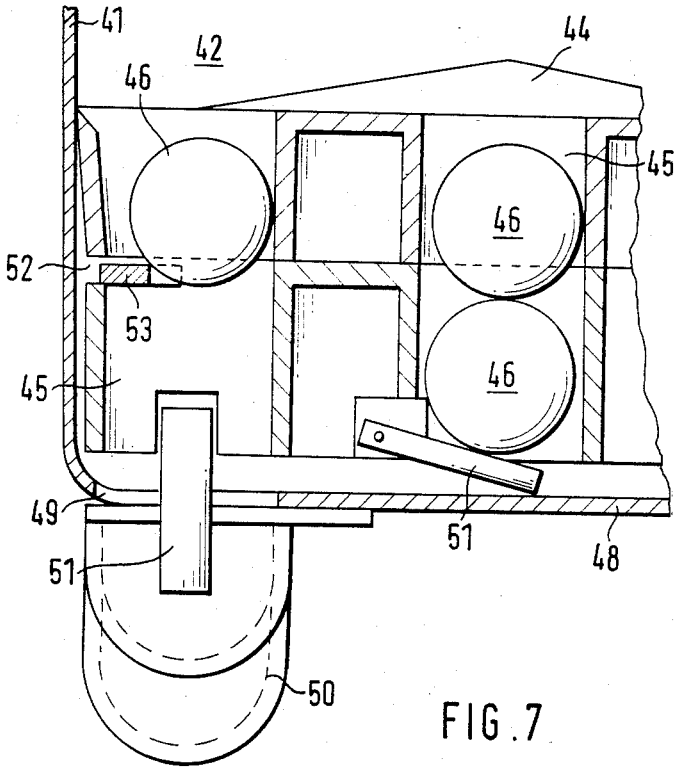
FIG. 7 is a sectional view taken along the line VII—VII in FIG. 5.

A second embodiment with a special construction of the turntable is shown in FIGS. 5 to 7. Details of the device, which are of only minor significance for the invention but are set out in the drawings for the sake of completeness, will not be fully described.

A ball storage container 41 is suspended in the housing 12 of the ball throwing machine. A ball separating device which is designated overall by the character 43 is inserted in a circular recess 42 in the ball storage container 41 and can rotate freely therein with a small gap between it and the wall around the recess 42 and is driven by a geared motor (not shown). The separating device 43 has a two-tier turntable 44 with vertical passages 45 of a width which somewhat exceeds the diameters of the balls 46 to be separated. In the present case the two-tier turntable 44 is made up of two parts **44*a*, 44*b*** mounted one above the other so as to be fixed against rotation relative to each other.

The direction of rotation of the turntable 44 is indicated by the arrow 47 in FIG. 6. The recess 42 in the ball storage container is closed below the turntable 44 by a base 48 in which a hole 49 is located on the circumferential path of the passages 45 at the ball delivery point, and a ball guide 50 is arranged below this hole and a ball 46 falling through this hole runs down the ball guide in a manner which is of no great interest here to a ball accelerating mechanism (not shown).

To ensure that the balls 46 lying one above the other in two layers in the passages do not come into contact with the base surface 48 during transport on the circumferential path, especially when these balls have strongly adhering surfaces, a drag bar 51 on which the ball lying in the lower layer rests is pivotally mounted below each passage 45 in front of the passage in the direction of rotation. Each drag bar corresponds to the drag bar 35 in FIG. 2(C). At the ball delivery point the drag bar 51 can swivel spontaneously downwards through the hole 49 (see FIG. 7) and allow the ball resting on it to fall out through the hole.

To ensure that the ball 46 lying in the upper layer does not also descend through the hole 49 when the lower ball is delivered, a ball stop is located in this peripheral region of the rotating turntable. According to the invention the ball stop ring 53 which is mounted eccentrically and freely rotatable in a peripheral groove 52 in the turntable 45, the eccentricity of the ring 53 being chosen so that the ring penetrates furthest into the peripheral groove 52 at the ball delivery location, i.e., above the hole 49 in the base 48, and thus at this point prevents the ball 46 located in the upper tier or in the part **44*a* of the turntable 44 from falling into the lower part 44*b* of the turntable. The eccentricity of the ring 53, which constantly alters relative to the turntable 44 during its rotation but remains unchanged relative to the recess 42 in the ball storage container, is ensured by supports for the ring relative to the recess 42. These supports can be seen in FIG. 6 in the form of two spacers 54 which have rollers 55 to reduce the friction with the ring 53 which rotates predominantly with the turntable 44, whilst a further roller 56 constitutes a third support point for the ring 53 at a point in the recess 42 in the storage container lying opposite the connecting centre of the spacers 54**.

It can be seen from the plan view of FIG. 6 that at least in the peripheral region of the path of movement of the passages which lies opposite the ball delivery point the eccentric ring 53 clears the passages 45 for a ball to pass from the upper into the lower level, but that on the other hand the advance of the eccentric ring 53 into the cross-section of the passages 45 takes place so gradually and without movement relative to the turntable 44 in the peripheral direction that even balls with stronly adhering surfaces are not jammed or damaged but are raised gently and prevented from falling through.

A readily flexible leaf spring 58 projecting through an opening 57 in the wall above the turntable 44 serves to guide balls which move with the turntable when the storage container is almost empty into the passages 45. The spring 58 is so flexible that it can be pushed through the opening 57 when a number of balls are contained in the storage container 41.

I claim:

1. A ball feed device for use in a ball throwing machine, especially in a machine for throwing squash balls or tennis balls, comprising a container arranged to store a supply of balls each having a predetermined diameter; a driven turntable rotatable in said container below the supply of balls therein in a substantially horizontal plane about a substantially vertical axis and having at least one substantially vertical passage of a width somewhat greater than said diameter and a length at least twice said diameter so that the passage can receive at least two superimposed balls, said passage being remote from said axis and having an open ball-receiving upper end and an open ball-dispensing lower end, said turntable further having a groove communicating with said passage at a location spaced apart from said lower end by a distance at least approximating said diameter; and a ball separating member extending into said groove and into said passage between two lowermost balls therein when said passage is in a ball feed position with an aligned separate ball discharge opening can discharge only one ball at a time.

2. The ball feed device of claim 1, wherein said turntable comprises two discrete discs which are disposed one above the other and at least the lower of which has a thickness at least substantially matching said diameter, said groove being disposed between said discs.

3. The ball feed device of claim 2, wherein said turntable further comprises a spacer disposed between said discs and surrounded by said groove.

4. The ball feed device of claim 1, wherein said ball stop includes a ring which is freely rotatable in said groove and is eccentric with reference to said turntable.

5. The ball feed device of claim 4, wherein said container has a wall surrounding the turntable and including means for radially movably supporting said ring.

6. The ball feed device of claim 5, wherein said supporting means includes rollers.

7. The ball feed device of claim 4, wherein said ring contains a plastic material having good sliding properties.

8. The ball feed device of claim 1, wherein said turntable has a peripheral surface and said passage is close to said peripheral surface.

9. The ball singularizing device of claim 1, further comprising a base member disposed below said turntable and which has rotatable portions that prevent balls from leaving said passage except in a predetermined angular position of said turntable, said base member being rotatable with said turntable, and said portions being movable out of register with said passage in said predetermined angular position of the turntable so as to allow one ball to leave said passage.

10. The ball feed device of claim 9, wherein said container has a stationary base located below said turntable and having a discharge opening in register with said passage in said predetermined angular position of said turntable, said base member including a foil tab which is fixed to the underside of said turntable in front of said passage, as considered in the direction of rotation of said turntable, and extends essentially below the entire lower end of said passage when the latter is out of register with said opening.

11. The ball feed device of claim 9, wherein said base member includes a drop shutter which is movably mounted at the underside of said turntable, said container having a stationary base disposed below said shutter and having a ball discharging opening in register with said passage when said turntable assumes said predetermined angular position, said shutter being arranged to pivot into said opening in said predetermined angular position of said turntable and to be pivoted against the underside of said turntable by the base of said container in response to rotation of said turntable beyond said predetermined angular position.

12. The ball feed device of claim 9, wherein said base member comprises a swivel arm pivotally mounted on the turntable to normally extend in a plane which is substantially parallel to the underside of the turntable and substantially diametrically below the lowermost ball in said passage, and further comprising control means for pivoting said arm so that the arm permits the lowermost ball to leave said passage in said predetermined angular position of said turntable.

13. The ball feed device of claim 12, wherein said control means comprises a ramp.

14. The ball feed device of claim 12, further comprising means for yieldably biasing said arm into said plane.

15. The ball feed device of claim 1, wherein said turntable has a plurality of passages and a base member for each of said passages.

* * * * *